US006829800B2

(12) United States Patent
Roebuck

(10) Patent No.: US 6,829,800 B2
(45) Date of Patent: Dec. 14, 2004

(54) BUCKET GRASP FOR SPIN RESISTANT MIXING

(76) Inventor: Phillip J. Roebuck, 405 Back Acres Ct., Virginia Beach, VA (US) 23454

( * ) Notice: Subject to any disclaimer, the term of this patent is extended or adjusted under 35 U.S.C. 154(b) by 0 days.

(21) Appl. No.: 10/246,920

(22) Filed: Sep. 18, 2002

(65) Prior Publication Data

US 2003/0106158 A1 Jun. 12, 2003

Related U.S. Application Data

(60) Provisional application No. 60/340,809, filed on Dec. 12, 2001.

(51) Int. Cl.[7] ..... B25F 1/00; B67B 7/00

(52) U.S. Cl. ..... 7/151; 7/105; 7/161

(58) Field of Search ..... 7/105, 151, 152, 7/156, 158, 161

(56) References Cited

U.S. PATENT DOCUMENTS

| | | | | | |
|---|---|---|---|---|---|
| 1,698,111 | A | * | 1/1929 | Terrell | 30/353 |
| 2,006,944 | A | * | 7/1935 | Courtney | 220/286 |
| 2,861,337 | A | * | 11/1958 | Behlau | 30/410 |
| 3,163,389 | A | * | 12/1964 | Thornburgh | 248/211 |
| 3,204,907 | A | * | 9/1965 | Tattrie | 248/211 |
| 3,872,745 | A | * | 3/1975 | Garza et al. | 81/3.55 |
| 4,176,417 | A | * | 12/1979 | Ruff | 7/161 |
| D312,038 | S | * | 11/1990 | Sachs | D8/371 |
| 5,222,265 | A | * | 6/1993 | Hermansson | 7/156 |
| D337,492 | S | * | 7/1993 | Ryan et al. | D8/21 |
| 5,228,159 | A | * | 7/1993 | Gurka | 7/105 |
| 5,584,520 | A | * | 12/1996 | Niemeier | 294/34 |

* cited by examiner

*Primary Examiner*—Hadi Shakeri
(74) *Attorney, Agent, or Firm*—Donald W. Meeker

(57) ABSTRACT

A bucket grasp tool keeps a bucket from spinning while mixing viscous fluid, such as drywall compound, in the bucket with a mechanical mixer and can also open bucket lids. The bucket grasp for spin resistant mixing is an assembly made up of two parts: a grasp part and a foot pressure part, which may have a surface grip portion. The grasp part is of a semi-circular shape and is made of rigid or semi-rigid material. The foot pressure part is of a smooth curved or straight shape and is made of rigid or semi-rigid material. The grasp part and the foot pressure part are integral, preferably both parts being formed from the same piece of material.

11 Claims, 3 Drawing Sheets

BUCKET GRASP FOR SPIN RESISTANT MIXING

CLAIM OF PROVISIONAL APPLICATION RIGHTS

This application claims the benefit of U.S. Provisional Patent Application No. 60/340,809, filed on Dec. 12, 2001.

BACKGROUND OF THE INVENTION

1. Field of the Invention

The present invention relates to construction tools and in particular to a bucket grasp tool for holding down a bucket by the handle and preventing rotation of the bucket, such as a bucket of drywall compound, while using a mechanical stirrer to stir the compound, with one foot pressed against the bucket grasp tool.

2. Description of the Prior Art

In the gypsum drywall industry taping compounds are used, some of which must be mixed with potable water prior to application. In the plastering industry, pails of premixed plaster weighing in the order of 25 kg must be mixed with cement before being applied as a patching and finishing compound. In both industries, a portable mixer having mixing paddles which rotate at approximately 400–600 RPM is used to mix the cementations or viscous materials. When the mixer is inserted into the cementatious or viscous materials in the pail, the pail tends to rotate with the mixer. To prevent this, the installer must use his or her legs, feet or other means to rigidly hold the pail so as to prevent the pail from turning as the material is mixed. This is potentially dangerous, as mixing in this manner may cause injury or loss of balance to the worker because of the awkward position which he or she must assume to maintain control over the operation.

If the workman does not grip the pail between the workman's lower legs prior to effecting the mixing of the contents, the pail will rotate in the same direction as the direction of mixing, and then will commence to oscillate about the lower surface of the pail in an entirely uncontrolled manner. This can result in the contents of the pail being discharged onto the workman's clothes and onto the floor in a random and totally uncontrolled manner.

When the pail is gripped between the workman's lower legs, rotation of the pail and oscillation thereof relative to the supporting substrate is reduced to an acceptable level or even eliminated. If, however, the workman relaxes his grip on the pail, then, the pail can rapidly spin, causing damage and injury to the workman's lower legs by impacting of the bails of the pail onto the workman's shinbones, a situation which results in great discomfort to the workman.

In operation, a worker will stand on the rim of the bucket and engage the power stirrer. Standing on the rim is most dangerous should the operator slip or the bucket break. Further, if the bucket is overfilled the centrifugal force created by the stirring action will result in spillage and wasted manpower for clean-up.

Mixing drywall compound has always been a hassle. A person has to hold the bucket between his feet, causing strain to the lower legs or stand on top of the bucket, which is dangerous and causes dirt to fall into the bucket from the bottom of a person's shoes.

There have been other inventions that do the same job, but they all are more bulky and not at all as convenient.

U.S. Pat. No. 4,877,208, issued Oct. 31, 1989 to Edsel Kennard, Jr., provides a support for a mixer bucket including a raised platform having a recess shaped to accommodate a mixer bucket. Resistance means are provided in the recess which engage against the bucket to maintain the bucket stationary while the contents of the bucket are being mixed.

U.S. Pat. No. 5,150,804, issued Sep. 29, 1992 to Blanchet, et al., shows a rotationally resistive pail, pail support and coupling. The apparatus includes a pail, and a lid for closing the pail in a closing position, and for supporting the pail in a supporting and locking position. The pail has notches in the base of the pail. The lid has corresponding lugs for vertical interlocking and rotationally resistive engagement with the notches when the lid is in the supporting position. When the lid is in the supporting position, the lid supports the pail vertically and laterally, and the mating engagement of the lid and pail resists relative rotation between the lid and the pail.

U.S. Pat. No. 5,232,188, issued Aug. 3, 1993 to George Troncone, claims a jib, for use in supporting a pail during a mixing operation to be carried out within the pail, including a support ring which is distorted into an elliptical condition, thus relying on the interfitment of two members of elliptical form to prevent rotation of the pail relative to the jig.

U.S. Pat. No. 5,228,159, issued Jul. 20, 1993 to Philip W. Gurka, describes a combination tool comprising a one-piece thin elongated rigid normally flat blank applied with bends, apertures and incisions thereon, providing a body portion on one end in combination with a right angle extension to a straight oblique handle portion on the other end, the front end of said body portion formed with a reverse bend providing a terminal extended hook furnished with integral means to remove plastic lids, be receptive to a container handle and also perform as a hammer-head, the rear-end of said body portion provided with a right angled bend projected in the opposite direction of said terminal extended hook side and precedes an extension furnished with a bend to said oblique handle portion, the concave side of said body portion's rear-end right angled bend, when faced upward also forms a receptive hook for a container handle, said oblique handle portion furnished with a reverse bend to provide a terminal hook on the same side as said body portion's terminal extended hook, said terminal hook formed to hold-fast from various supports for the other individual hooks to be stabilized thereby, said handle portion also provided with dual nail extractor apertures to remove nails, said handle portion further provided with an oblong appendage to remove metal lids, and still further, said handle portion provides for said hammer-head to be a complete hammer to close lids tightly.

U.S. Pat. No. 6,361,001, issued Mar. 26, 2002 to Mark Roger Durand, a container holder, for mixing slurry material in a 2½ or 5 gallon bucket. The container holder is formed from a one-piece raised top portion having a centrally disposed aperture allowing insertion of a stirring paddle. Depending from the top portion are two legs that extend downwardly and span the entire height of the bucket to be mixed with foot pads joined at the bottom of the legs extending outwardly therefrom which allow an individual to stand on during the mixing operation.

U.S. Pat. No. 4,216,685, issued Aug. 12, 1980 to John W. Taylor indicates a container opener which takes the form of an integral member which has a main straight body section. At one end of the main body section is attached the first extension which depends from the main body section at almost a right angle. The outermost end of the first extension is acutely arcuate so that it substantially bends over on itself with the outermost tip of the extension defining an angle of sixty degrees with respect to the plane of the main body section. A second extension is attached to the main body section and is to be generally curved and ending in a depending flange which is to be connectable with the locking tab type of pail lid.

U.S. Pat. No. 2,006,944, issued Jul. 2, 1933 to Nicholas P. Courtney, puts forth a form of can opener for friction top cans adapted to be moved to various points around the periphery of the can cover and to be used as a prying implement to remove the cover from the can.

There is still a need for a simple, convenient, and easily carried tool for restraining buckets while mixing fluids in the buckets.

SUMMARY OF THE INVENTION

An object of the present invention is to prevent a 5-gallon bucket from spinning while drywall compounds are being mixed together with a drill and paddle.

Another object of the present invention is to help workmen avoid strain to their lower legs caused by needing to hold a bucket between the feet, and the dangers associated with standing on top of the bucket which can also cause dirt to fall into the compound being mixed from the bottom of shoes.

One more object of the present invention is to function simply by hooking the handle of a bucket and letting the other end rest on the ground to receive body weight.

A further object of the present invention is to use the weight of a person's body to hold a bucket firmly in place.

An additional object of the present invention is to make a simple tool out of rigid material such as plastic or metal and a semi-rigid material such as rubber.

A contributory object of the present invention is to be formed from the same piece of material to maintain an integral nature.

An added object of the present invention is to be less bulky and more convenient to use than prior art inventions.

A separate object of the present invention is to have a strip of material small enough to fit between the bucket and bucket lid to be used to open the bucket lids by prying up and against the bucket.

Yet another object of the present invention is to include a straight edge sharpened to cut bucket lid tabs from underneath the top by prying against the bucket.

An auxiliary object of the present invention is to include reinforcement bars on the grasp part for tools made of weaker materials such as plastic.

Another corollary object of the present invention is to be formed with a high friction patterned surface molded into the foot pressure portion for extra traction.

An ensuing object of the present invention is that it can be manufactured inexpensively.

In brief, a bucket grasp tool keeps a bucket from spinning while mixing viscous fluid, such as drywall compound, in the bucket with a mechanical mixer. The bucket grasp for spin resistant mixing is an assembly made up of two parts: namely, a grasp part, and a foot pressure part, which may have a surface grip part. The grasp part is preferably semi-circular shaped and is preferably made of rigid material such as plastic or metal or semi-rigid material such as rubber. The foot pressure part is curve-shaped and preferably made of rigid material such as plastic or semi-rigid material such as rubber. The surface grip part may be flat and follow the curvature of both the grasp part and the foot pressure part. It is preferably made of flexible material such as rubber. The grasp part and the foot pressure part are integral, preferably both parts being formed from the same piece of material. The surface grip part lines the grasp part and covers the foot pressure part, being interconnected preferably with glue.

The present invention also opens bucket lids. It has a cutter blade cut into the tool at an angle adjacent to an end of the tool that contacts the ground. The cutter blade cuts the bucket lid tabs. Then the small end of this tool can be hooked under each tab and pried up.

An advantage of the present invention is to prevent a 5-gallon bucket from spinning while drywall compounds are being mixed together.

Another advantage of the present invention is to help workmen avoid strain to their lower legs and the dangers associated with standing on top of the bucket.

An additional advantage of the present invention is to function simply by hooking the handle of a bucket.

One more advantage of the present invention is to use the weight of a person's body to hold a bucket firmly in place.

Yet another advantage of the present invention is to be made out of readily available materials such as plastic or metal and rubber.

Still another advantage of the present invention is to be formed from a single piece of material.

Again, another advantage of the present invention is to be less bulky and more convenient to use.

The next advantage of the present invention is to include a straight edge sharpened to cut bucket lid tabs and a strip of material small enough to be used to pry open bucket lids.

An extra advantage of the present invention is to include reinforcement bars on the grasp part of the tool.

An associated advantage of the present invention is to be formed with a high friction patterned surface molded into the foot pressure portion for extra traction.

A final advantage of the present invention is that it can be manufactured inexpensively.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
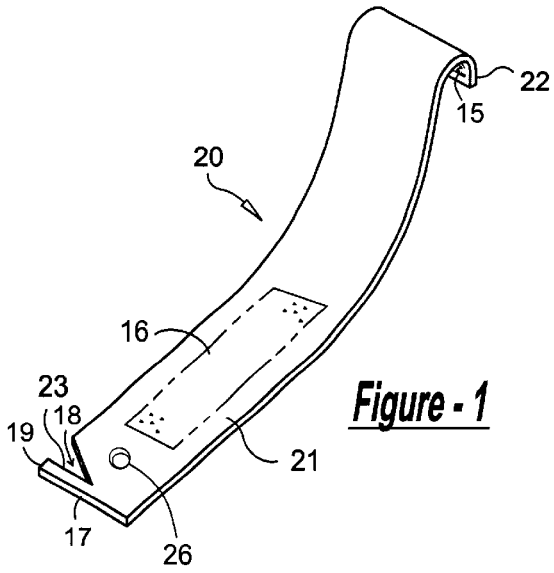
FIG. 1 is a perspective view of the preferred embodiment of the invention having a curved end hook for the bucket handle with the curve straightening out into a flat foot pressure portion to receive the foot of the worker and a cutting blade built into the end of the bucket grasp tool for cutting the bucket lid tabs.

In FIGS. 1–7, a bucket grasp device comprises a tool 20 and 20A–D for holding down a bucket 30 securely to prevent rotation while a mechanical mixer is used to mix a viscous fluid in the bucket. The rigid elongated tool 20 has a hook 22, 22A at a distal end, with the hook 22 being capable of hooking over a handle 31 on a bucket 30, a proximal end 17 capable of resting on a support surface, and a rigid surface forming a foot pressure portion 21, 21A therebetween capable of receiving a foot of a user to apply pressure to the tool 20 and 20A–D and hold down the bucket 30 on the support surface. A hole 26 adjacent to the proximal end 17 enables hanging of the tool when not in use.

The tool 20 and 20A–D is fabricated from an elongated strip of rigid material having a hook 22, 22A formed in the material at the distal end, a flat proximal end 17, and a smooth foot pressure portion 21 therebetween.

Figure 2:
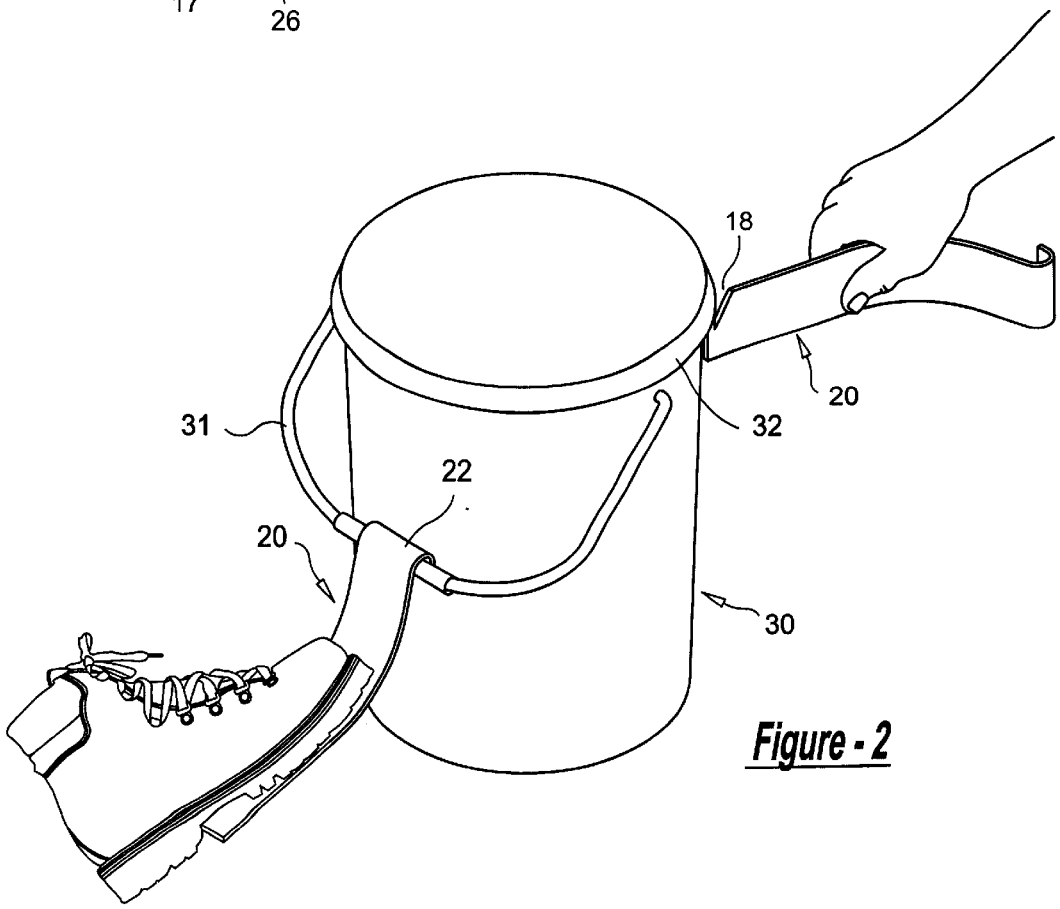
FIG. 2 is a perspective view of the preferred embodiment of the invention shown holding down a bucket and also shown cutting the bucket lid tab.

In FIGS. 1 and 2, the tool 20 further comprises a sharp cutting edge 23 formed in one side of the tool adjacent to the proximal end 17, the cutting edge 23 being capable of cutting a bucket lid 32, as shown on the right in FIG. 2. An opening 18 is formed in one side of the tool immediately adjacent to the proximal end 17 of the tool leaving a strip of material 19 between the opening and the proximal end that is sufficiently small to fit between the bucket 30 and the bucket lid 32 and the strip of material 19 is provided with a sharp edge 23 on the opening side so that the sharp edge is capable of cutting the edge of the bucket lid 32.

In FIGS. 1–5, the distal end of the tool 20 is formed with a curved hook 22 extending across the width of the tool. In FIGS. 1 and 2, the curved hook 22 straightens out into a flat foot pressure portion 21 extending to the proximal end 17 of the tool.

Figure 4:
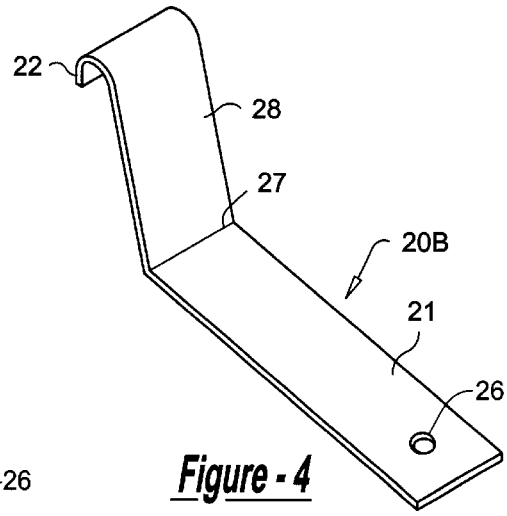
FIG. 4 is an alternate embodiment of the invention having a curved hook on the end of a flat almost vertical portion which interconnects at an angle with a flat foot pressure portion.

In FIG. 4 the curved hook 22 of the tool 20B extends downwardly into a flat vertical portion 28 which interconnects at an angle 27 with a flat foot pressure portion 21.

Figure 5:
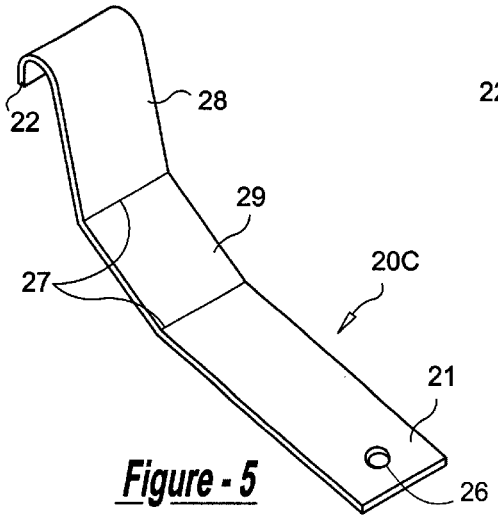
FIG. 5 is an alternate embodiment of the invention having a curved hook on the end of a flat vertical portion which interconnects at an angle with two angled flat surfaces forming the foot pressure portion.

In FIG. 5, the curved hook 22 of the tool 20C extends downwardly into a flat vertical portion 28 which interconnects at an angle 27 with two angled flat surfaces (29, 21) forming the foot pressure portion 29, 21.

Figure 6:
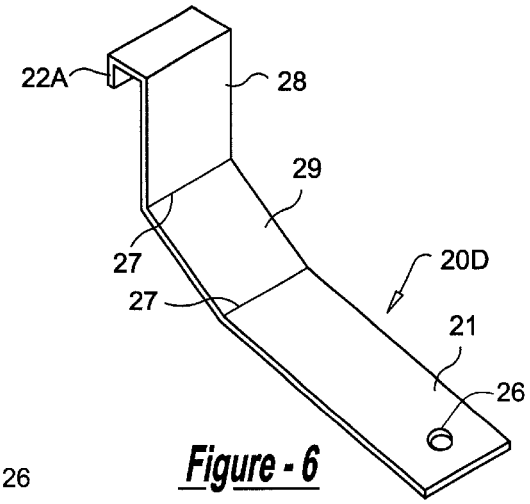
FIG. 6 is an alternate embodiment of the invention having an angled hook on the end of a flat vertical portion which interconnects at an angle with two angled flat surfaces forming the foot pressure portion.

In FIG. 6, the distal end of the tool is formed with an angled hook 22A extending across the width of the tool 20D. The angled hook 22A has a flat vertical portion 28 extending downwardly which interconnects at an angle 27 with two angled flat surfaces forming the foot pressure portion 29, 21.

Figure 7:
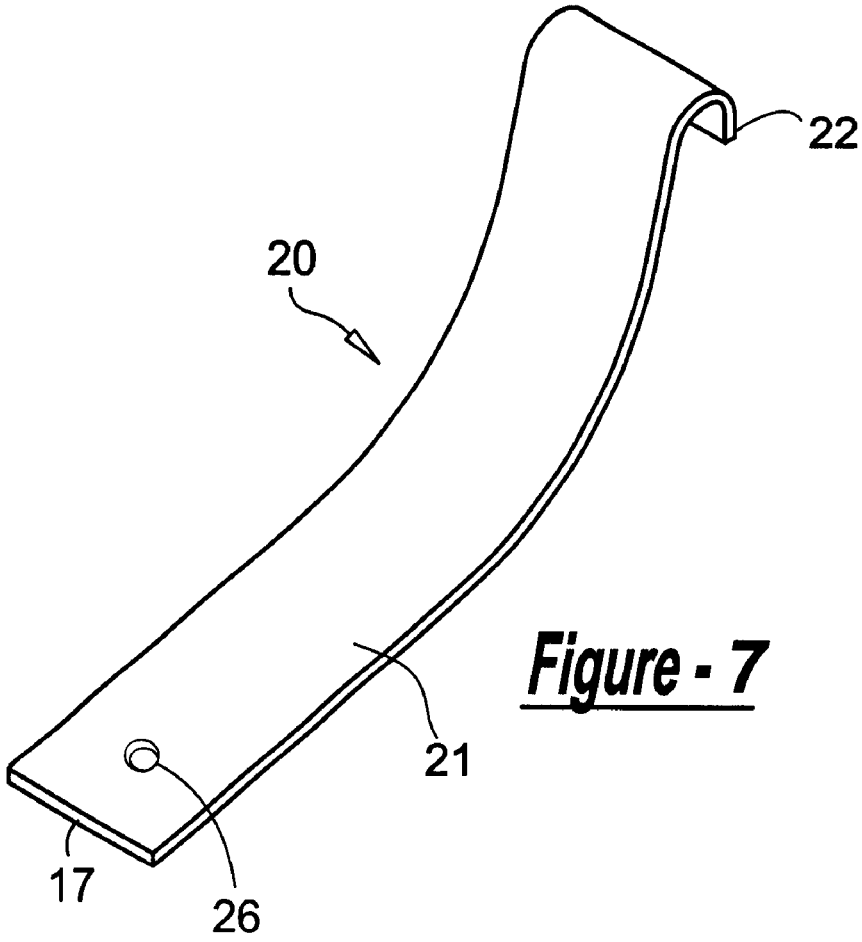
FIG. 7 is a perspective view of a simplified embodiment of the invention having a curved end hook for the bucket handle with the curve straightening out into a flat foot pressure portion to receive the foot of the worker and a hole for hanging when not in use.

In FIG. 7 a simplified embodiment of the invention 20 has a curved end hook 22 for the bucket handle with the curve straightening out into a flat foot pressure portion 21 to receive the foot of the worker and a hole 26 adjacent to the proximal end 17 for hanging the tool when not in use.

Figure 3:
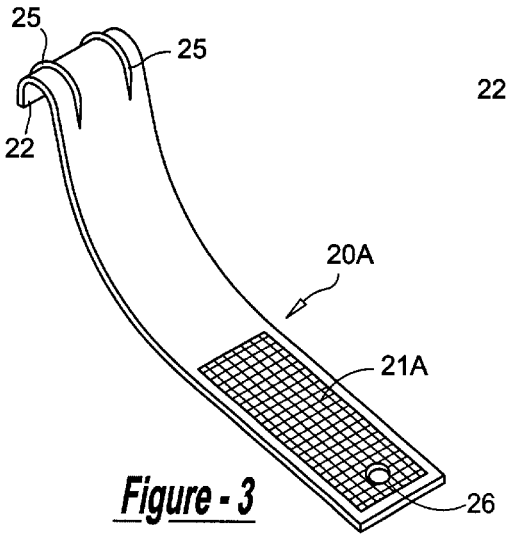
FIG. 3 is an alternate embodiment of the invention, preferably formed of molded plastic with extra ridges over the curved hook for extra strength and a high friction patterned surface molded into the foot pressure portion for extra traction.

In FIG. 3, the tool 20A is formed of molded plastic with extra ridges 25 over the hook 22 for extra strength and a high friction patterned foot pressure portion 21A molded into the surface for extra traction.

In FIGS. 1, 2 and 4–6, the tool 20 and 20B–D is formed of thick steel sheeting cut and bent to form the tool 20.

In FIG. 1, the tool 20 may have a high friction surface 16 on the foot pressure portion 21 and a high friction surface 15 under the hook 22 which is attached by gluing.

In operation, the bucket grasp 20 for spin resistant mixing is used on a bucket 30, as seen in FIG. 2, while mixing viscous fluids in the bucket with a mechanical mixer such as a drill and paddle. The grasp part 22 is hooked on the bucket handle 31, while the foot pressure part 21 rests with a proximal end 17 on the floor. Pressure is applied by a person's foot to the foot pressure part, while the surface grip part ensures firm contact for both the person's foot on the foot pressure part and the grasp part grasping the bucket handle. This pressure holds the bucket in place while mixing the fluid in the bucket, preventing the bucket from spinning.

The tool can be made out of any rigid material; such as metal or plastic or other rigid material. The tool works by simply hooking the small end on the handle of the bucket and letting the other end rest on the floor. A person then stands on the tool, thereby, holding the bucket firmly in place by the weight of his body.

It is understood that the preceding description is given merely by way of illustration and not in limitation of the invention and that various modifications may be made thereto without departing from the spirit of the invention as claimed.

What is claimed is:

1. A bucket grasp device for holding down a bucket securely to prevent rotation while a mechanical mixer is used to mix a viscous fluid in the bucket, the device comprising:

a rigid elongated tool having a hook at a distal end, the hook extending horizontally across a width of the tool, the hook being adapted for hooking over a handle on a bucket and holding the handle down, a proximal end having a straight horizontal edge adapted for resting on a horizontal support surface, which support surface supports the bucket, and a rigid surface therebetween adapted for receiving a foot of a user to apply pressure to the tool and hold down the bucket on the support surface;

wherein the tool is fabricated from an elongated strip of rigid material with the hook formed in the material at the distal end, the proximal end being flat, and the rigid surface therebetween comprising a high friction foot pressure portion having a higher surface friction than the rest of the rigid surface;

wherein a V-notch opening is formed in one side of the tool adjacent to said proximal end defining a sharp cutting edge parallel with said straight horizontal edge; and wherein the hook straightens out into the high friction foot pressure portion, the high friction foot pressure portion further having a flat surface extending to the proximal end of the tool.

2. The bucket grasp device of claim 1 wherein the distal end of the tool is formed with a curved hook extending across the width of the tool.

3. The bucket grasp device of claim 2 wherein the curved hook extends downwardly into a flat vertical portion connecting at an angle with the high friction foot pressure portion.

4. The bucket grasp device of claim 2 wherein the curved hook extends downwardly into a flat vertical portion connecting at an angle with a flat surface, said flat surface being connected with a same said angle to the high friction foot pressure portion.

5. The bucket grasp device of claim 1 wherein the distal end of the tool is formed with an angled hook extending across the width of the tool.

6. The bucket grasp device of claim 5 wherein the angled hook extends downwardly into a flat vertical portion connecting at an angle with the high friction foot pressure portion.

7. The bucket grasp device of claim 5 wherein the angled hook extends downwardly into a flat vertical portion connecting at an angle with a flat surface, said flat surface being connected with a same said angle to the high friction foot pressure portion.

8. The bucket grasp device of claim 1 wherein the tool comprises a molded plastic elongated strip with extra ridges over the hook for extra strength and the high friction foot pressure portion is formed by applying a high friction patterned surface on the foot pressure portion for extra traction.

9. The bucket grasp device of claim 1 wherein the tool comprises a steel sheeting elongated strip cut and bent to form the tool.

10. The bucket grasp device of claim 1 further comprising a high friction surface on the hook.

11. The bucket grasp device of claim 1 wherein the rigid surface further comprises a through hole adjacent to the proximal end serving as a means for hanging the device when not in use.

* * * * *